US006052551A

United States Patent [19]

De Cock et al.

[11] Patent Number: 6,052,551

[45] Date of Patent: Apr. 18, 2000

[54] ELECTROSTATOGRAPHIC PRINTER AND METHOD

[75] Inventors: Etienne Marie De Cock, Edegem; Peter Eelen, Zoersel; Wim Jacques Josephine Michielsen, Wommelgem, all of Belgium

[73] Assignee: Xeikon N.V., Mortsel, Belgium

[21] Appl. No.: 09/049,843

[22] Filed: Mar. 27, 1998

[30] Foreign Application Priority Data

Apr. 7, 1997 [EP] European Pat. Off. ..... 97302343

[51] Int. Cl.[7] ..... G03G 15/16

[52] U.S. Cl. ..... 399/296; 399/307; 399/308; 399/309; 399/401

[58] Field of Search ..... 399/307, 309, 399/401, 66, 296, 299, 302, 306, 308; 101/220, 229, 254

[56] References Cited

U.S. PATENT DOCUMENTS

| | | | |
|---|---|---|---|
| 2,200,316 | 5/1940 | Wieking et al. | 101/220 |
| 4,992,833 | 2/1991 | Derimiggio | 399/308 |
| 5,155,536 | 10/1992 | Johnson et al. | 355/290 |
| 5,168,313 | 12/1992 | Hosaka et al. | 399/313 |
| 5,410,384 | 4/1995 | Wachtler | 399/309 |
| 5,546,178 | 8/1996 | Manzer et al. | 399/384 |
| 5,805,967 | 9/1998 | De Bock et al. | 399/307 |
| 5,893,018 | 4/1999 | De Bock et al. | 399/302 |

FOREIGN PATENT DOCUMENTS

| | | |
|---|---|---|
| 0557858 | 9/1993 | European Pat. Off. . |
| 4442837 | 6/1995 | Germany . |
| 56167165 | 12/1981 | Japan . |
| 57022273 | 2/1982 | Japan . |
| 59095563 | 6/1984 | Japan . |

*Primary Examiner*—William Royer
*Assistant Examiner*—William A. Noë
*Attorney, Agent, or Firm*—Baker Botts L.L.P.

[57] ABSTRACT

The invention is an electrostatographic printer and a method of printing with such a printer. The printer includes a transfer member that is driven along a continuous path, and a toner image depositor that deposits a toner image in powder form on the transfer member. A substrate is fed into contact with the transfer member, and the toner image on the transfer member is heated in advance of the transfer; the transfer member is cooled following the image transfer to a temperature below the glass transition temperature $T_g$ of the toner; then further toner images may be deposited on the transfer member. A controlling pressure roller is positioned in opposition to the transfer member to form a transfer nip, through which the substrate passes, the substrate wrapping partially around the pressure roller both in advance of and following the transfer nip. The temperature of the controlling pressure roller can be governed to control the temperature of the substrate as it passes through the nip, thus attaining improved image transfer.

12 Claims, 3 Drawing Sheets

ELECTROSTATOGRAPHIC PRINTER AND METHOD

FIELD OF THE INVENTION

This invention relates to an electrostatographic printer and to a method of electrostatographic printing.

BACKGROUND TO THE INVENTION

An electrostatographic printer is known in which a toner image in powder form is deposited on a moving transfer member and a substrate is fed along a substrate path into contact with the transfer member, whereby the toner image is transferred to one face of the substrate. To improve the quality of image transfer to the substrate, it has been proposed to heat the toner image on the transfer member in advance of the transfer of the toner image to the substrate and to cool the transfer member following the transfer of the toner image therefrom to the substrate to a temperature below the glass transition temperature $T_g$ of the toner, prior to the deposition of further toner images on the transfer member. At the transfer site, a pressure roller is positioned in opposition to the transfer member to form a transfer nip therebetween, through which the substrate path passes.

While such a construction is able to produce good quality results, it is found that the quality of transfer to the substrate is not consistent, there being a variation between the quality when the printer is started up after an idle period and the quality after the printer has been running for some time.

OBJECTS OF THE INVENTION

It is an object of the present invention to provide such a printer having a more consistent output quality.

SUMMARY OF THE INVENTION

We have discovered that this objective and other useful benefits can be obtained if the substrate wraps partially around the pressure roller both in advance of and following the transfer nip and the temperature of the pressure roller is controlled.

Thus, according to a first aspect of the invention, there is provided an electrostatographic printer comprising:

a transfer member;

drive means for moving the transfer member along a continuous path;

deposition means for depositing a toner image in powder form on the transfer member;

substrate feed means to feed substrate along a substrate path into contact with the transfer member, whereby the toner image is transferred to at least one face of the substrate;

heating means for heating the toner image on the transfer member in advance of the transfer of the toner image to the substrate;

cooling means for cooling the transfer member following the transfer of the toner image therefrom to the substrate to a temperature below the glass transition temperature $T_g$ of the toner, prior to the deposition of further toner images on the transfer member;

a pressure roller positioned in opposition to the transfer member to form a transfer nip therebetween, through which the substrate path passes, the substrate path wrapping partially around the pressure roller both in advance of and following the transfer nip; and means for controlling the temperature of the pressure roller.

According to a second aspect of the invention, there is provided a method of multi-color electrostatographic printing comprising:

moving a transfer member along a continuous path;

electrostatically depositing a toner image in powder form onto the moving transfer member;

feeding substrate along a substrate path into contact with the moving transfer member, whereby the toner image is transferred to at least one face of the substrate;

heating the toner image on the moving transfer member in advance of the transfer of the toner image to the substrate;

cooling the transfer member following the transfer of the toner image therefrom to the substrate to a temperature below the glass transition temperature $T_g$ of the toner, prior to the deposition of further toner images on the second transfer member, wherein the transfer member is positioned in opposition to a pressure roller to form a transfer nip therebetween, through which the substrate path passes, the substrate path wrapping partially around the pressure roller both in advance of and following the transfer nip; and controlling the temperature of the pressure roller, thereby to control the temperature of the substrate passing through the transfer nip.

The heating means for the transfer member may comprise infra-red radiant heating means, although other forms of heating including HF radiation, induction heating, convection heating and conduction heating, for example the use of heated rollers, are also suitable. The temperature to which the toner image on the transfer member is heated is important. In particular, the surface of the toner image should contact the substrate at a temperature above the melting temperature of the toner, so as to ensure complete transfer of the toner image to the substrate and the fixing of the image on the substrate.

The cooling means for the transfer member may comprise convection or conduction cooling devices, for example, means for bringing the transfer member into contact with cool air, a fan directing cool air onto the surface of the transfer member or a cooled roller over which the transfer member passes. The temperature to which the transfer member is cooled prior to the deposition of further toner image thereon is also important. In particular, the surface of the transfer member should be reduced to a temperature below the glass transition temperature $T_g$ of the toner, such as to about room temperature.

While not wishing to be bound by theory, it is our understanding that it is generally preferred to transfer toner images from a material of relatively low surface energy to one of relatively high surface energy. This reduces the possibility of toner particles shearing during transfer which reduces the efficiency of the transfer process and leaves residual toner on the donor surface. Ideally therefore, the surface energy of the donor surface should be lower than that of the receiving surface. This can be achieved for the transfer of the image from the transfer member to the substrate, since the surface energy of the substrate, such as paper, is generally more than 45 dyne/cm. The transfer process is more efficient when the donor surface is at a higher temperature than the receiving surface. Thus the present invention requires heating of the toner image on the transfer member so as to maximize the efficiency of the transfer to the substrate.

Preferably, the printer further comprises means for controlling the pressure exerted by said pressure roller at said transfer nip. A suitable pressure is from 0.1 to 1.0 $N/mm^2$, depending upon the materials of which the pressure roller, the transfer member and the substrate are formed, and this pressure may be controlled by mounting the pressure roller in a movable manner by way of adjustable springs or by the use of a controllable linear motor.

The transfer member may have an outer surface formed of a material having a low surface energy, for example silicone elastomer (surface energy typically 20 dyne/cm), polytetrafluoroethylene, polyfluoralkylene and other fluorinated polymers. The transfer member is preferably in a form having a low mass, so that the surface thereof can be easily heated prior to the transfer of the toner image to the substrate and easily cooled after transfer of the toner image to the substrate and before transfer of another toner image to the transfer member from the primary belt. For this reason, while the transfer member can be in the form of a transfer roller or drum, it is preferably in the form of a transfer belt, for example an endless metal belt of 40 $\mu$m thickness coated with 40 $\mu$m thickness silicone elastomer.

The transfer member plays the role of transferring the toner image to the substrate. It is not necessary therefore that the transfer member has a photoconductive surface. Indeed, the need to heat and cool the transfer member means that the use of conventional photoconductor materials is to be avoided, since the photoconductive properties of such materials are sensitive to temperature changes.

The invention is applicable both to monochrome and to multi-color printers, especially single pass multi-color printers. In a multi-color printer, the deposition means may include means for depositing a plurality of toner images of different colors in powder form in register with each other on the transfer member to form a multiple toner image thereon. In the following description, where reference is made to a single toner image formed by a single image forming station, except where the context does not so allow, it is to be understood that the reference is equally applicable to a multiple toner image formed by multiple image forming stations.

By specifying that the toner image is electrostatically deposited onto the moving transfer member, we mean that either (Option 1) the toner image is firstly formed by one or more toner image deposition devices on another member and then electrostatically deposited as such onto the transfer member, or (Option 2) one or more toner image deposition devices operate to deposit toner images directly onto the transfer member.

Thus, according to one embodiment of Option 1 of the invention, the transfer member is an intermediate transfer member and the means for forming a toner image on the transfer member comprises:

a primary transfer member;

means for guiding the primary transfer member past at least one toner image producing station whereby a toner image is formed on the primary transfer member, the intermediate transfer member being in contact with the primary transfer member downstream of the image producing stations, where the toner image is electrostatically transferred from the primary transfer member to the cooled intermediate transfer member. In this embodiment, the primary transfer member is preferably constituted by a primary belt.

In order to reduce energy loss to the environment, we prefer that the means for heating the toner image on the transfer member is in heat exchange relationship with the means for cooling the transfer member after transfer. For example, the means for heating the multiple toner image on the transfer member comprises a pre-heating roller and the means for cooling the transfer member comprises a pre-cooling roller, the pre-heating roller and the pre-cooling roller being in heat exchange relationship with each other. This heat exchange relationship can be achieved for example by each of the heating and cooling rollers being hollow rollers through which a heat exchange fluid, such as water, is caused to flow. In this way heat extracted by the cooling roller is transferred to the heating roller and contributes to the heating of the toner image on the transfer member.

In order not to disturb the toner image on the transfer member between the deposition of the image thereon and the transfer of the image to the substrate, we prefer that the surface of the transfer member which carries the image is free of contact with any other member. Thereby, undesirable transfer of the image, or a part thereof, from the transfer member is avoided. Thus, where for example the transfer member is in the form of a belt, rollers or other guide means, contact the belt on the surface thereof opposite to that carrying the image, at least between the deposition of the image and its transfer to the substrate.

The primary belt may have, for example, a toner image carrying surface formed of an electrically non-conductive material. The electrically non-conductive material is preferably selected from polyethylene terephthalate, silicone elastomer, polyimide (such as KAPTON—Trade Mark), and mixtures thereof. The primary belt may consist entirely of this material, or be in the form of a base material coated with such an electrically non-conductive material. The base material of the primary belt may be a metal, such as stainless steel, a polyimide, a polyvinyl fluoride, a polyester, and mixtures thereof. Polyester has the advantage of good mechanical and electrical characteristics and of being less sensitive to humidity.

The transfer of the toner image from the primary belt to the intermediate transfer member is more difficult to achieve if the intermediate transfer member has a relatively low surface energy. While there would therefore be an advantage in heating the primary belt between its image producing station and its contact with the intermediate transfer member, there is a risk of the temperature becoming too high. This problem can be avoided according to the present invention, by transferring the toner image from the primary belt onto the intermediate transfer member by electrostatic means or by a combination of electrostatic means and heat. This has an added advantage of reducing the risk of toner—toner shearing at those portions of the image where toner of one color may lie directly over toner of another color.

Drive to the primary belt is preferably derived from the drive means for the intermediate transfer member, by making use of adherent contact between the primary belt and the intermediate transfer member causing the primary belt and the intermediate transfer member to move in synchronism with each other. Adherent contact between the primary belt and the image producing stations may be used to ensure that the one or more image producing stations move in synchronism with the primary belt. The primary belt preferably passes over a guide roller positioned in opposition to the intermediate transfer member to form a nip or contact region there between.

Means for cleaning the primary belt, and optionally also means for cooling the primary belt, are preferably provided after contact with the intermediate transfer member.

Means for tensioning the primary belt may be provided in order to improve the quality of transfer of the multiple toner image therefrom to the intermediate transfer member and, in the case of a printer making use of two or more image producing stations, to ensure good registration of the toner images thereon. Means for controlling the transverse position and movement of the primary belt may also be included.

Each toner image producing station may comprise a rotatable endless surface means, means for forming an electrostatic latent image on the rotatable endless surface means, means for developing the electrostatic image to form a toner image on the rotatable endless surface means and transfer means for transferring the toner image onto the primary belt. The rotatable endless surface means is preferably a drum having a photosensitive surface. The transfer means may comprise a transfer roller located at the face of the primary belt opposite to the drum, or a corona transfer device. When the transfer means is a transfer roller, the primary belt is in contact with the drum over a contact angle of less than 5°, measured at the axis of the rotatable endless surface means, e.g. substantially tangential contact. However, when the transfer means is a corona transfer device, the primary belt is preferably in contact with the drum over a contact angle of more than 5° so that adherent contact between the primary belt and the rotatable endless surface means enables drive to be reliably transmitted from the primary belt to the drum. The reliability of this transfer is enhanced by tensioning the primary belt.

The use of an intermediate transfer belt has other advantages over, for example, the use of a transfer roller. One run or section of the transfer belt may be heated while the other run is cooled. In this manner, the temperature of the transfer belt at its point of contact with the substrate can be higher than its temperature at its point of contact with the primary belt, leading to an improvement in toner transfer and reducing the chances of offset ghost image effects. For the production of glossy images, it is advisable that the surface of the intermediate transfer member be as flat as possible. In particular it is advantageous if the surface roughness $R_a$ is less than 0.2 $\mu$m. For the production of matte images, the surface roughness may be higher. The use of a transfer belt in place of a transfer roller as the intermediate transfer member enables the contact area between this member and the primary belt to be greater. This enables the adherent contact there between to be improved thereby providing a more reliable transmission of drive from the intermediate transfer member to the primary belt without increase in pressure.

In an embodiment of Option 2 of the invention, the primary belt and the intermediate transfer member are constituted by one and the same member. The transfer member may be constituted by a belt and there are provided means for guiding the belt past one or more toner image producing stations where toner images are transferred to the belt, and the substrate feed means are arranged to feed substrate along a substrate path into contact with the belt.

The substrate is preferably in the form of a web. Web cutting means, optionally together with a sheet stacking device may be provided downstream of the intermediate transfer member. Alternatively, the web is not cut into sheets, but wound onto a take-up roller.

The substrate may alternatively be in the form of cut sheets, or other articles of suitable shape.

The substrate path preferably has a wrapping angle about the pressure roller of at least 10° in advance of the transfer nip. With a smaller wrapping angle, the substrate will only be in contact with the surface of the pressure roller over a short distance before reaching the transfer nip, unless a pressure roller with a large diameter is used. The longer the distance over which the substrate is in contact with the pressure roller, the more complete is the transfer of heat from the pressure roller to the substrate. In general, transfer of heat from the pressure roller to the substrate is more complete when the contact time is high, that is when (i) the wrapping angle is wide, (ii) the pressure roller diameter is large, and (iii) the peed of the substrate through the transfer nip is low. The transfer of heat is also a factor of the material of which the substrate is formed and the surface characteristics of the pressure roller.

The wrapping angle of the substrate path about the pressure roller beyond of the transfer nip need only be small, for example at least 1°. This encourages good separation of the substrate carrying the toner image from the transfer member.

There is no theoretical upper limit to the total wrapping angle, other than that imposed by the geometry of the printer. Usually however a total wrapping angle of up to about 180° will suffice.

The temperature of the pressure roller is preferably controlled to a temperature of from 40 to 100° C., most preferably from 60 to 80° C.

The printer may be adapted for duplex printing. In this embodiment, the printer may further comprise deposition means for depositing a second toner image on a second transfer member, the substrate feed means being adapted to feed substrate along a substrate path into contact with the second transfer member, whereby the second toner image is transferred to the opposite face of the substrate. Heating means will be included for heating the second toner image on the second transfer member in advance of the transfer of the second toner image to the substrate. Cooling means will be provided for cooling the second transfer member following the transfer of the second toner image therefrom to the substrate to a temperature below the glass transition temperature $T_g$ of the toner, prior to the deposition of further toner images on the second transfer member. A second pressure roller will be positioned in opposition to the second transfer member to form a second transfer nip there between, through which the substrate path passes, the substrate path wrapping partially around the second pressure roller both in advance of and following the second transfer nip. Means will be provided for controlling the temperature of the second pressure roller.

The second transfer member may be a second intermediate transfer member and the means for forming a second multiple toner image on the second transfer surface may then comprise:

a second primary transfer member;

means for guiding the second primary transfer member past one or more second toner image producing stations whereby a second toner image is transferred to the second primary transfer member to form the second toner image on the second primary transfer member, the second intermediate transfer member being in contact with the second primary transfer member downstream of the second image producing station.

The first and second intermediate transfer members are spaced from each other, each being provided with a respective pressure roller to define a second transfer nip through which the substrate passes. Drive to the second intermediate transfer member may be derived from the first intermediate transfer member or may be derived from a separate drive motor, controlled to drive the second intermediate transfer member in synchronism with the first intermediate transfer member. When the substrate is in the form of a web, the substrate may be in contact with position sensing device between the first and second intermediate transfer members, the output of which sensing device can be used to control the drive motors of the respective intermediate transfer members to ensure that the intermediate transfer members run at the same mean speed.

In an alternative construction of the printer, capable of printing in duplex without the need to provide a second set of image producing stations, substrate guiding means are positioned downstream of the transfer nip to turn the substrate and redirect it to the transfer nip, to transfer a further toner image from the transfer member to the opposite face of the substrate.

For example, where the substrate is in the form of a web, the transfer belt is at least twice as wide as the substrate web and the toner image producing stations, the second stage heating roller, the temperature controlled pressure roller are similarly wide. The substrate web passes over the pressure roller towards one end thereof, where one face of the substrate web has transferred thereon an image from the transfer belt. The substrate web is now directed over two web-guiding devices, such as air-bearings, to bring the substrate web back to the transfer nip but with the opposite face thereof now directed towards the transfer belt. The substrate web now passes through the transfer nip towards other end thereof, where the other face of the substrate web has transferred thereon a second image from the transfer belt.

In this embodiment, the toner image producing stations will be programmed to produce images on the transfer belt in a side-by-side staggered relationship, so that when transferred to the substrate web, images are positioned in a back-to-back relationship as desired. The method of programming toner image producing stations in this manner will be clear to those skilled in the art.

Dry-development toners essentially comprise a thermoplastic binder consisting of a thermoplastic resin or mixture of resins including coloring matter, e.g. carbon black or coloring material such as finely dispersed pigments or soluble dyes.

The mean diameter of dry toner particles for use in magnetic brush development is about 10 $\mu$m (ref. "Principles of Non Impact Printing" by Jerome L. Johnson—Palatino Press Irvine Calif., 92715 U.S.A. (1986), p. 64–85), but may be from 1 to 5 $\mu$m for high resolution development (see e.g. British patent specification (GB-A-2180948 and International patent specification WO-A-91/00548).

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. Such resins usually have a glass transition point of more than 45° C., usually above 54° C. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent applications EP-A-601235, and EP-A-628883 and International patent applications WO 94/27192, 94/27191 and 94/29770 (all Agfa-Gevaert NV). The glass transition temperatures of most common toner compositions are similar at about 55° C. and a melting point within the range of 90° to 155° C.

BRIEF DESCRIPTION OF THE DRAWINGS

The invention will now be described in further detail, purely by way of example, with reference to the accompanying drawings, in which.

DETAILED DESCRIPTION

Figure 1:
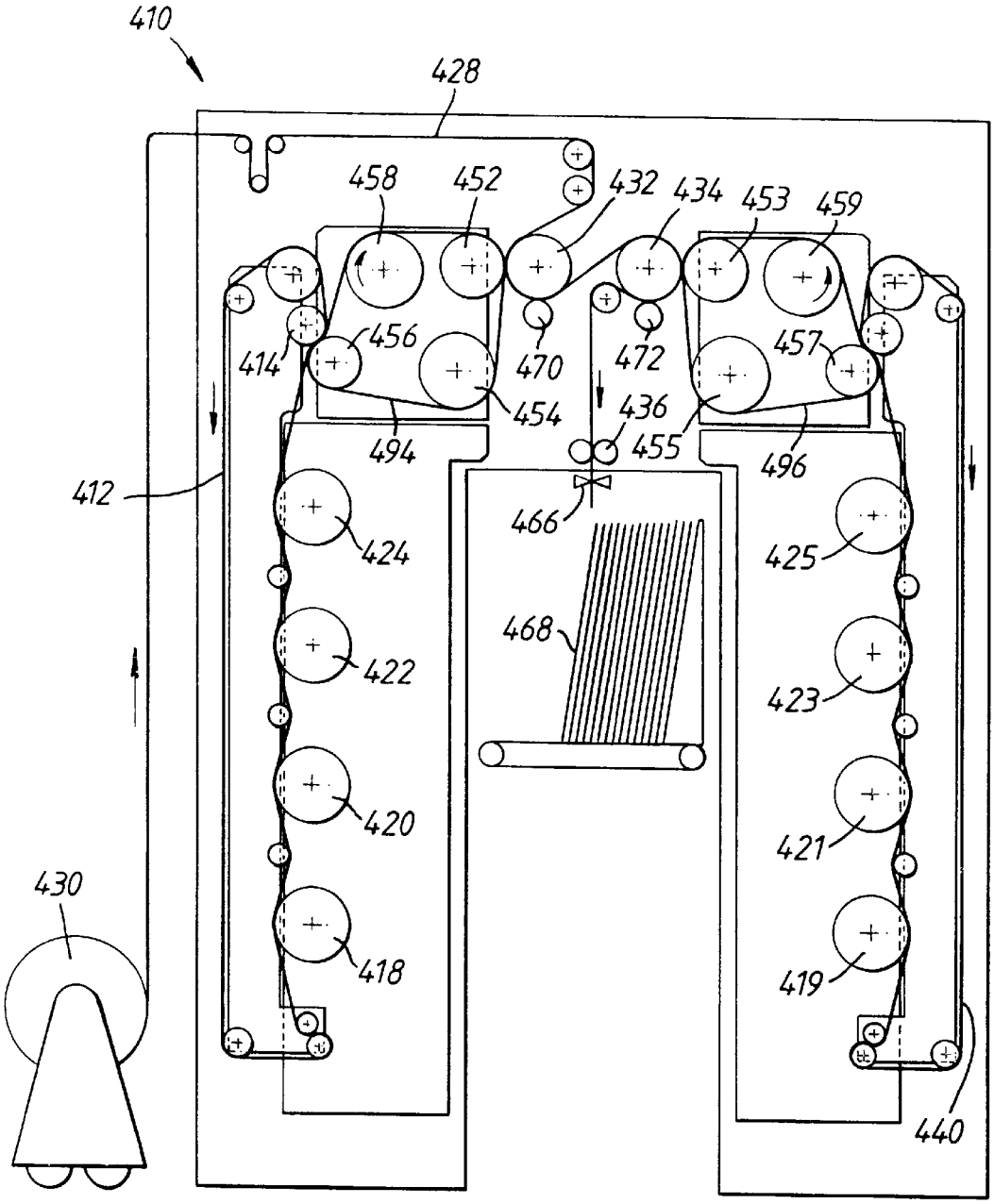
FIG. 1 shows a single pass, multi-color duplex electrostatographic printer according to an embodiment of the invention.
Figure 2:
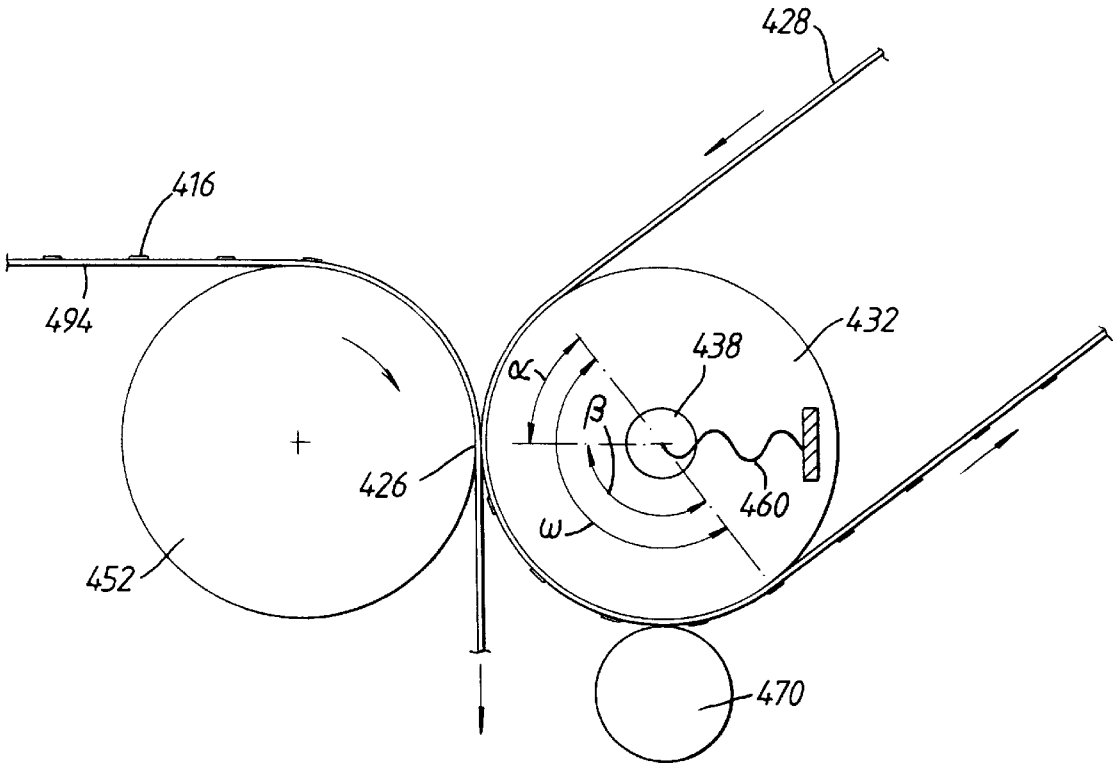
FIG. 2 is an enlarged portion of FIG. 1.

FIGS. 1 and 2 show a single pass, multi-color duplex electrostatographic printer 410. The printer comprises a first primary seamless belt 412 passing over guide rollers, including a guide roller 414. The primary belt 412 moves in a substantially vertical direction past a set of four toner image producing stations 418, 420, 422, 424. At the four toner image producing stations 418, 420, 422, 424, a plurality of toner images of different colors are transferred by transfer coronas (not shown) to the primary belt 412 in register with each other to form a first multiple toner image, as described in more detail in European patent application EP 629927 (Xeikon NV). These image producing stations may be similar to each other except in respect of the color of the toner with which they are supplied. The primary belt 412 has a toner image carrying surface formed for example of polyethylene terephthalate. Means may be provided for tensioning that part of the primary belt 412 which extends past the toner image producing stations 418, 420, 422, 424.

An intermediate transfer member in the form of a grounded seamless transfer belt 494, is in contact with the primary belt 412 downstream of the last image producing station 424. In this embodiment, the intermediate transfer belt is in the form of a metal band of 70 $\mu$m thickness carrying a 25 $\mu$m thickness silicone rubber coating. The transfer belt 494 passes over spaced guide rollers 452, 454, 456 and 458 which are so positioned as to bring the transfer belt 494 into contact with the toner image carrying belt 412 as it passes over its upper guide roller 414. The transfer belt 494 is preferably tensioned by means not shown, for example by spring loading one of the guide rollers, such as the guide roller 454.

The guide roller 458 acts as a first stage heating roller, being formed as a hollow roller through the hollow interior of which a heat transfer fluid such as water at an elevated temperature is passed. The guide roller 452 acts as a second stage heating roller, being formed for example with an internal radiant heater. The guide rollers 454 and 456 act as first and second stage cooling rollers, being formed with a hollow interior through which cooling fluid, such as water, at a controlled temperature close to room temperature passes. A heat transfer circuit (not shown) is provided, whereby heated extracted by the cooling fluid from the transfer belt 494 at the first stage cooling roller 454 is transferred to the first stage heating roller 458 to raise the temperature of the multi-color toner image on the transfer belt before transfer to the substrate. This arrangement reduces the energy requirement. The heat transfer fluid may be subjected to additional heating as, or before, it enters the hollow interior of the first stage heating roller 458 and/or may be subjected to further cooling as, or before it enters the hollow interior of the first stage cooling roller 454.

Drive is transmitted in turn from a drive motor (not shown) to the guide roller 452, via the transfer belt 494 to the primary belt 412 downstream of the toner image producing stations and to the toner image producing stations themselves.

The guide roller 414 and the intermediate transfer belt 494 are positioned in opposition to each other to form a contact region there between, through which the primary belt 412 passes. Adherent contact between the primary belt and the intermediate transfer belt causes the primary belt, the image producing stations, and the intermediate transfer belt to move in synchronism with each other.

The multiple toner image 416 (see also FIG. 2) adhering to the surface of the primary belt 412 is transferred to the moving intermediate transfer belt 494 by a second function of guide roller 414 acting as an electrostatic transfer roller connected, for example, to −1000 V.

In a typical embodiment, the first-stage heating roller 458 raises the temperature of the multi-color toner image 416 on the transfer belt 494 to about 90° C., the second-stage heating roller 452 raises the temperature further to about 160° C., the optimum temperature for final transfer to the paper web 428. Following transfer of the image 416 to the substrate 428 the first-stage cooling roller 454 reduces the temperature of the transfer belt 494 to about 90° C., while the cooling roller 456 reduces the temperature of the transfer member to about 30° C., ideal for electrostatic transfer of a further image onto the transfer belt 494. By the use of an elevated temperature at the point of transfer to the paper web 428, and by virtue of the higher surface energy of the paper web relative to the intermediate transfer belt 494, the transfer of toner is 100% complete, so that there may be no necessity to clean excess toner particles from the intermediate transfer belt. Nevertheless, a cleaning device, such as a cleaning roller, may be provided to remove any residual toner particles from the intermediate transfer belt, which residual particles may result during an emergency stop or paper breakdown.

The printer is adapted for duplex printing. To achieve this, the printer further comprises a second primary belt 440 which moves past a second set of four toner image producing stations 419, 421, 423, 425. At the four toner image producing stations 419, 421, 423, 425, a plurality of toner images of different colors are transferred to the primary belt in register with each other to form a second image.

A second intermediate transfer belt 496 is in contact with the second primary belt 440 downstream of the last image producing station 425 of the second set. The second intermediate transfer belt is guided over first and second stage cooling rollers 455, 457, a first-stage heating roller 459, and the second-stage heating roller 453.

The intermediate transfer belts serve to feed the paper web 428 through the printer. Thus the paper web is brought into contact with the first and second intermediate transfer belts 494, 496 whereby the first multiple toner image is transferred to one face of the paper web while the second multiple toner image is transferred to the opposite face thereof.

The paper web 428 is unwound from a supply roll 430 and passes into the printer. The web passes over freely rotating counter pressure rollers 432 and 434 to a pair of web drive rollers 436, driven by a slave motor (not shown). Tension in the web 428 is controlled by application of a brake (not shown) applied to the supply roll 430. Downstream of the drive roller pair 436, the paper web passes to a cutting station 466 where the web is cut into sheets which are collected in a stack 468. The pressure rollers 432 and 434 are respectively opposed to the second stage heating rollers 452 and 453 to form first and second transfer nips there between.

As can be seen more clearly in FIG. 2, the paper web 428 is in contact with the pressure roller 432 over a wrapping angle $\omega$ of about 180°, including a portion $\alpha$ of about 45°, in advance of the transfer nip 426 and a portion $\beta$ of about 135° following the transfer nip 426. The pressure roller 432 is temperature controlled. To achieve this, the roller has a hollow interior 438 through which a temperature control fluid such as water is passed. The roller interior 438 is included in a fluid circuit (not shown) which includes heating, cooling and temperature sensing devices in order to maintain the fluid at a substantially constant temperature of about 70° C. When the printer is first used after a period of rest, the pressure roller 432 is approximately at room temperature. The temperature control fluid therefore needs to be heated in order to raise the temperature of the pressure roller 432. As printing proceeds, some heat is transferred from the second stage heating roller 452, which is at about 160° C. through the substrate 428 to the pressure roller 432. The temperature control fluid now needs to be cooled in order to keep the temperature of the pressure roller 432 at about 70° C. A substantially constant temperature difference is therefore established across the transfer nip 426, leading to a substantially constant transfer quality.

The pressure roller 432 is mounted in a movable manner on adjustable springs 460 so that the pressure which it exerts at the transfer nip is adjustable. A suitable pressure is about 0.3 $N/mm^2$, which is achieved by the mounting springs exerting a force of 400 N at end of the roller, the rollers having a length of 300 mm and the nip having a length of about 8 mm.

Glossing rollers 470 and 472 are located each opposed to an associated one of the pressure rollers 432 and 434 to form a glossing nip through which the paper web 428 passes.

Figure 3:
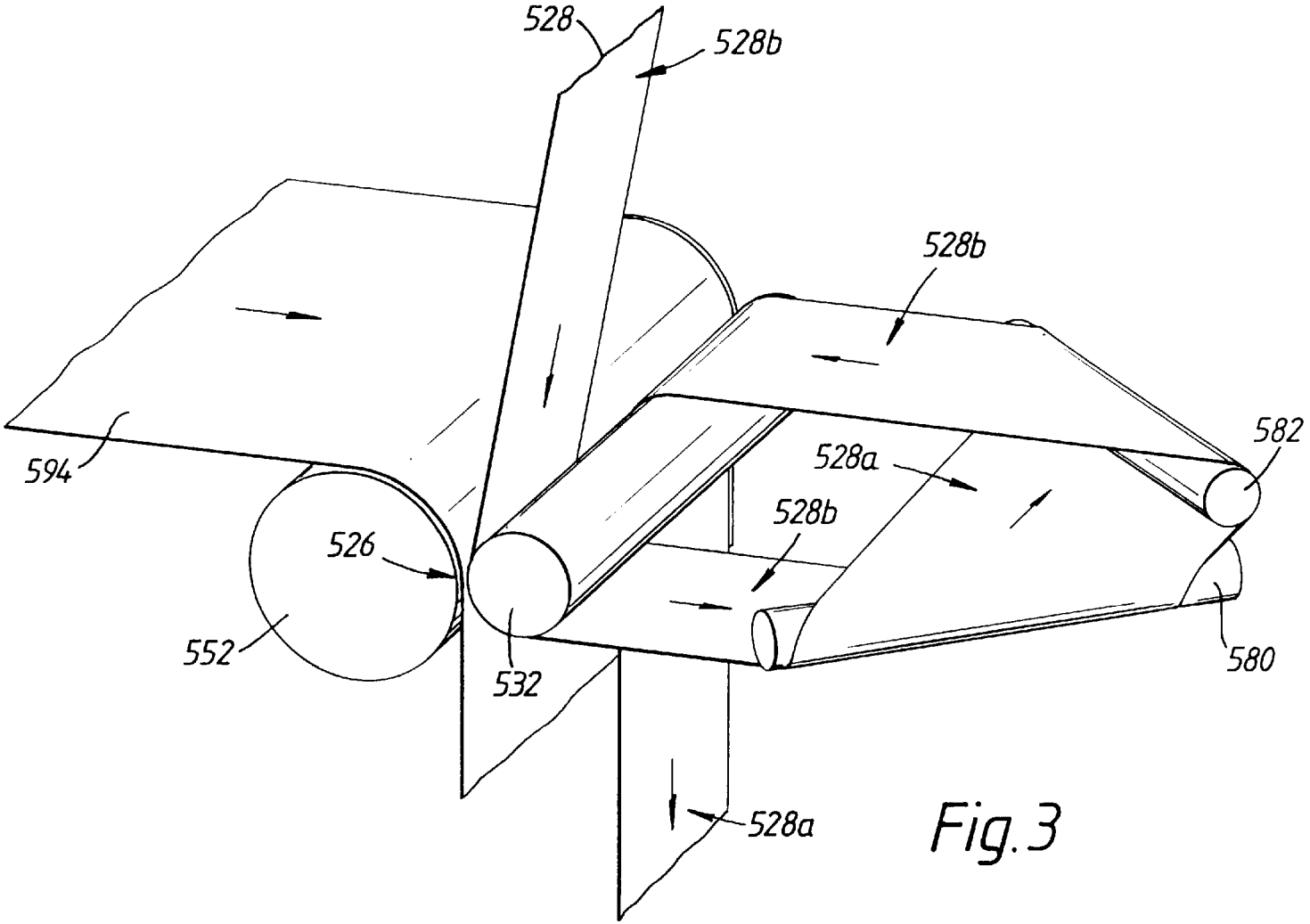
FIG. 3 shows the transfer station of an alternative construction of part of the printer shown in FIGS. 1 and 2.

FIG. 3 shows the transfer station of an alternative construction, whereby duplex printing may be achieved in a simple manner, without the need to provide a second set of image producing stations.

In the embodiment shown in FIG. 3, the transfer belt 594 is at least twice as wide as the paper web 528. For example, the transfer belt 594 has a width of 500 mm, while the paper web 528 has a width of 210 mm. The second stage heating roller 552 and the temperature controlled pressure roller 532 are similarly wide. Also, the toner image producing stations (not shown in FIG. 3) are similarly wide.

The pressure roller 532 and the second stage heating roller 552 together form a transfer nip 526. The paper web 528 passes over the pressure roller 532 towards one end thereof, where one face 528*a* of the paper web has transferred thereon an image from the transfer belt 594, in a manner similar to that described in connection with FIGS. 1 and 2.

This embodiment differs however, in that the paper web 528 is now directed over two web-guiding devices 580, 582, such as air bearings, set at oblique angles with respect to the web path direction. In this manner the paper web is brought back to the transfer nip 526, but with the opposite face thereof now directed towards the transfer belt 594.

The paper web 528 now passes over the pressure roller 532 towards other end thereof, through the transfer nip 526, where the other face 528*b* of the paper web has transferred thereon a second image from the transfer belt 594. Thereafter, the paper web may progress to a cutting device as in the embodiment shown in FIGS. 1 and 2.

In this embodiment, the toner image producing stations will be programmed to produce images on the transfer belt 594 in a side-by-side staggered relationship, so that when transferred to the paper web by the transfer station shown in FIG. 3, images are positioned in a back-to-back relationship as desired.

What is claimed is:

1. An electrostatographic printer comprising:

a first transfer member;

drive means for moving said first transfer member along a continuous path;

first deposition means for depositing toner to form a first toner image in powder form on said first transfer member;

substrate feed means to feed a substrate along a substrate path into contact with said first transfer member, whereby said first toner image is transferred to one face of said substrate;

first heating means for heating said first toner image on said first transfer member in advance of transfer of said first toner image to said substrate;

a first pressure roller for applying and controlling pressure to said substrate, positioned in opposition to said first transfer member to form a first transfer nip therewith, through which said substrate path passes, said substrate path wrapping partially around said first pressure roller both in advance of and following said first transfer nip; and first temperature control means for controlling the temperature of said first pressure roller.

2. The electrostatographic printer according to claim 1, wherein said substrate path has a wrapping angle about said first pressure roller in advance of said first transfer nip of at least 10°.

3. The electrostatographic printer according to claim 1, wherein said substrate path has a wrapping angle about said first pressure roller following said first transfer nip of at least 1°.

4. The electrostatographic printer according to claim 1, further comprising first pressure control means for controlling pressure exerted by said first pressure roller at said first transfer nip.

5. The electrostatographic printer according to claim 4, wherein said first pressure roller is movably mounted on adjustable springs.

6. The electrostatographic printer according to claim 1, adapted for duplex printing, further comprising:

second deposition means for depositing a second toner image on a second transfer member, said substrate feed means being adapted to feed said substrate along said substrate path into contact with said second transfer member, whereby said second toner image is transferred to an opposite face of said substrate;

second heating means for heating said second toner image on said second transfer member in advance of transfer of said second toner image to said substrate;

a second pressure roller positioned in opposition to said second transfer member to form a second transfer nip therewith downstream of the first transfer nip, through which said substrate path passes, said substrate path wrapping partially around said second pressure roller both in advance of and following said second transfer nip; and second temperature control means for controlling the temperature of said second pressure roller.

7. The electrostatographic printer of claim 6, further comprising cooling means for cooling said second transfer member following transfer of said first toner image therefrom to said substrate to a temperature below the glass transition temperature $T_g$ of said toner, prior to deposition of further toner images on said second transfer member.

8. The electrostatographic printer according to claim 1, adapted for duplex printing, further comprising substrate guiding means positioned downstream of said first transfer nip to turn said substrate and redirect said substrate to said first transfer nip, to transfer a second, separate toner image from said first transfer member to an opposite face of said substrate.

9. The electrostatographic printer of claim 1, further comprising cooling means for cooling said first transfer member following transfer of said first toner image therefrom to said substrate to a temperature below the glass transition temperature $T_g$ of said toner, prior to deposition of further toner images on said first transfer member.

10. A method of electrostatographic printing comprising:

moving a first transfer member along a continuous path;

electrostatically depositing toner to form a first toner image in powder form to said first transfer member while said member is moving;

feeding a substrate along a substrate path into contact with said first transfer member while said member is moving, whereby said first toner image is transferred to one face of said substrate;

heating said first toner image on said first transfer member while said member is moving, in advance of transfer of said first toner image to said substrate, wherein said first transfer member is positioned in opposition to a first pressure roller (for applying and controlling pressure to said substrate), to form a first transfer nip therebetween, through which said substrate path passes, said substrate path wrapping partially around said first pressure roller both in advance of and following said first transfer nip; and controlling the temperature of said first pressure roller, thereby to control the temperature of said substrate passing through said first transfer nip.

11. The method of electrostatographic printing according to claim 10, wherein the temperature of said first pressure roller is controlled to a temperature between 40° C. and 100° C.

12. The method of electrostatographic printing of claim 10, further comprising the step of cooling said first transfer member following transfer of said first toner image therefrom to said substrate to a temperature below the glass transition temperature $T_g$ of said toner, prior to deposition of further toner images on second transfer member.

* * * * *